United States Patent [19]

Unger et al.

[11] 4,387,034

[45] Jun. 7, 1983

[54] MIXED ALKYLTHIONOCARBAMATES FLOTATION COLLECTORS AND ORE DRESSING METHODS IN WHICH THE COLLECTORS ARE EMPLOYED

[75] Inventors: Kim N. Unger; Dennis V. Smeltzer, both of Tucson, Ariz.

[73] Assignee: Thiotech, Inc., Delaware, Md.

[21] Appl. No.: 314,375

[22] Filed: Oct. 23, 1981

[51] Int. Cl.[3] ..... E22B 3/00; E22B 15/12

[52] U.S. Cl. ..... 252/61; 252/60; 209/166; 209/176; 210/704; 210/705; 210/728; 210/729

[58] Field of Search ..... 252/60, 61; 209/166, 209/167; 210/704, 705, 728, 729

[56] References Cited

U.S. PATENT DOCUMENTS

| | | | |
|---|---|---|---|
| 3,590,996 | 6/1971 | Harris | 260/455 A |
| 3,590,997 | 6/1971 | Harris | 260/455 A |
| 3,590,998 | 6/1971 | Collins | 260/455 A |
| 3,590,999 | 6/1971 | Gould et al. | 260/455 A |
| 3,787,471 | 1/1974 | Harris et al. | 260/455 A |

FOREIGN PATENT DOCUMENTS 591461 2/1976 U.S.S.R. .

OTHER PUBLICATIONS

Synthesis and Use of Flotation Reagents, Pascalide et al., 5-1964, Chemical Abstract, vol. 62, 1965, 12798C.

Interaction of Dialkylthionocarbamates with Sulfide Minerals, Flembotskii et al., 14(1)1971, Chemical Abstract, vol. 75, 1971, 390922.

*Primary Examiner*—John E. Kittle
*Assistant Examiner*—Hoa V. Le
*Attorney, Agent, or Firm*—Harry M. Weiss

[57] ABSTRACT

A collector for use in concentrating metal values in ores by flotation, said collector comprising a synergistic mixture of O-isopropyl N-ethylthionocarbamate and O-isobutyl N-methylthionocarbamate. Ore dressing flotation methods wherein said mixture serves as collector are also provided.

4 Claims, No Drawings

MIXED ALKYLTHIONOCARBAMATES FLOTATION COLLECTORS AND ORE DRESSING METHODS IN WHICH THE COLLECTORS ARE EMPLOYED

DESCRIPTION OF THE INVENTION

This invention relates generally to ore dressing methods and to concentration of metal values in ores by flotation. More particularly, the invention provides a new and valuable reagent for recovering metal values from ores, whereby froth flotation of a slurry of the ore is conducted in the presence of a collector comprising a mixture of certain thionocarbamates.

Flotation is a widely used method of concentrating ores, and it is believed to be the most commonly used ore dressing process. It is based on the fact that when air bubbles are introduced into a ground ore pulp, particles of some minerals will become attached to the bubbles, whereas other minerals will not become so attached and remain in the pulp. Certain chemicals facilitate flotation by conferring adherency and/or water repellency to surfaces of minerals to be floated, and such chemicals have been generally called "promoters" or "collectors". Herein, they will be referred to as collectors. It is customary in the art to employ other additives or reagents in flotation; for example, there may also be used materials which serve as frothers, activators, depressants or modifying agents. The presence or absence of such reagents and their nature will vary with ores and reaction conditions, and selection of such other additives for serving differing functions can be readily arrived at by easy experimentation.

The flotation art dates at least as far back as the early 1900's, and numerous materials have been found to serve as collectors, for example, the xanthates, the dithiophosphates; the thiocarbanilides and the thionocarbamates. Industrially, collectors for use in flotation are of great importance because even a very small improvement in the efficacy of the collector can have immense commercial effect. With the growing current practice of tailings retreatment, the cost efficiency of the collector becomes increasingly significant. Also of concern are possible toxicity and environmental implications as well as storage and handling.

Accordingly, an object of the invention is the provision of a collector in the flotation process which will give improved recovery of metal values at nominal cost and without substantial detriment to health and environment. Another object is the provision of a collector which will be useful with a great variety of sulfidic and non-sulfidic ores, including those of the precious metals. Still another object is the provision of a collector which will be effective even under conditions where slime interference may present a problem.

These and other objects hereinafter disclosed are met by the invention wherein there is provided a collector comprising a synergistic mixture of at least two different thionocarbamates of the formula:

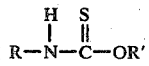

wherein each of R and R' is an alkyl radical of from 1 to 6 carbon atoms, said mixture consisting at least 20% by weight of a single one of said thionocarbamates. For example, the mixture may consist of from 20 to 80 parts by weight of (I) O-isopropyl N-ethylthionocarbamate and from 80 to 20 parts by weight of (II) O-isobutyl N-methylthionocarbamate. Other thionocarbamates which have the above formula and which are included in this invention are those in which each of R and R' is methyl, ethyl, propyl, n-butyl, tert-butyl, isoamyl, or n-hexyl. For example:

O-methyl N-isobutylthionocarbamate
O-hexyl N-ethylthionocarbamate
O-ethyl N-methylthionocarbamate
O-isopropyl N-isopropylthionocarbamate
O-butyl N-hexylthionocarbamate Any number of different thionocarbamates may be used; for example, each of the above five different thionocarbamates may be present in said mixture, provided that at least one of them is present in a quantity of at least 20% by weight of the mixture.

A preferred mixture consists of from, say, 33 parts to 50 parts by weight of (I) and from 50 to 67 parts by weight of (II). As will be hereinafter disclosed, synergism is demonstrated by using in a flotation process such mixtures of (I) and (II), rather than either (I) or (II), alone. Unexpectedly, significant increase in recovery of metal is achieved by employing the defined mixtures rather than either component.

Although the invention is very valuable for the concentration of copper, the presently provided thionocarbamate mixtures serve as excellent collectors in flotation processes, generally, including concentration of metals such as silver, gold, and zinc from ores in which such metals may be present at only very low levels. The presently provided mixtures of thionocarbamates are effective over a wide pH range, and can provide improved selectivity at substantial lime savings in alkaline flotation circuits.

The invention is further illustrated by, but not limited to, the following examples:

EXAMPLE I

This example describes testing of the following materials for collector efficacy in copper flotation:

I. O-isopropyl N-ethylthionocarbamate
II. O-isobutyl N-methylthionocarbamate
III. A 2:1 by weight mixture of I and II.
IV. A 1:1 by weight mixture of I and II.
V. A 1:2 by weight mixture of I and II.

Porphyry copper ore was crushed to 10 mesh and 700 g of the crushed ore was ground in the laboratory ball mill together with 500 mls of water, 3.8 g of lime, 5 mg of A-54 (a liquid hydrocarbon fraction supplied by Shell Oil Company), and 5 mg of one of the above collector materials, the 5 mg quantity corresponding to 0.014 lb of collector per ton of ore. The resulting slurry was transferred to a laboratory flotation machine, diluted, and conditioned with 20 ml of methylisobutylcarbinol. Air was then added with agitation to facilitate flotation of copper during a flotation time of five minutes. Assay of the resulting concentrates and tailings gave the following results.

| Collector Material | Copper Recovery, % |
|---|---|
| I | 69.3 |
| II | 68.1 |
| III | 68.9 |
| IV | 70.3 |
| V | 71.4 |

Acceptable grades of copper were obtained throughout the test series. For example, with collector IV, the grade value was 6.31%.

EXAMPLE II

This example is like Example I, except that each of collectors I, IV and V was used at a concentration of 10 mg, corresponding to about 0.028 lb of collector per ton of ore. The following results were obtained:

| Collector Material | Copper Recovery, % |
|---|---|
| I | 69.8 |
| IV | 71.8 |
| V | 72.3 |

Here again is demonstrated the synergism of the mixture of the two different thionocarbamates, as compared to the collector efficiency of only a single constituent.

EXAMPLE III

Proceeding as in Example I, assay of concentrate and tailings gave the following molybdenum values:

| Collector Material | Molybdenum Recovery, % |
|---|---|
| I | 87.7 |
| II | 87.6 |
| III | 87.4 |
| IV | 88.4 |
| V | 89.0 |

It will be noted that with collectors I and II, which consisted of only a single thionocarbamate, or with collector III, wherein there was a preponderance of the O-isopropyl compound as compared to the O-isobutyl compound, the percent recovery of molybdenum was much lower than it was with either a 1:1 mixture of the two thionocarbamates or with a mixture in which the O-isobutyl compound predominated.

The present mixture of O-alkyl N-alkylthionocarbamates are generally useful in ore dressing; but they are particularly useful in working with sulfides in that they demonstrate high selectivity against pyrite and pyrrhotite. They possess exceptional utility in the flotation of sulfide copper and copper activated zinc sulfide from alkaline pulps. In many cases where slime or talc interference is a problem, the mixed thionocarbamates will produce higher concentrate grades and recoveries. In the flotation of precious metals such as gold and silver, the presently provided thionocarbamate mixtures have been found to have a greater affinity than previously known collectors.

The herein described flotation procedures are given by way of illustration only, since any ore dressing flotation technique may be used so long as the presently provided synergistic mixtures are employed as collectors.

What is claimed is:

1. A collector for use in concentrating metal values in ores by flotation, said collector comprising a synergistic mixture consisting essentially of at least two different thionocarbamates of the formula

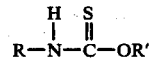

wherein each of R and R′ is an alkyl radical of from 1 to 6 carbon atoms, said mixture consisting at least 20% by weight of a single one of said thionocarbamates.

2. The collector defined in claim 1 further limited in that it is a mixture of from 30 to 55 parts by weight of O-isopropyl N-ethylthionocarbamate and from 70 to 45 parts by weight of O-isobutyl N-methylthionocarbamate.

3. The collector defined in claim 1, further limited in that it is a mixture of from 33 to 50 parts by weight of O-isopropyl N-ethylthionocarbamate and from 67 to 50 parts by weight of O-isobutyl N-methylthionocarbamate.

4. The collector defined in claim 1, further limited in that the metal is copper.

* * * * *